US008177606B2

(12) United States Patent
Loveless et al.

(10) Patent No.: US 8,177,606 B2
(45) Date of Patent: May 15, 2012

(54) DUST SHROUD FOR ROTARY TOOLS

(75) Inventors: Michael Loveless, Price, UT (US); Spencer Loveless, Price, UT (US); Brett H. Peterson, West Bountiful, UT (US)

(73) Assignee: Dustless Depot, LLC, Price, UT (US)

( * ) Notice: Subject to any disclaimer, the term of this patent is extended or adjusted under 35 U.S.C. 154(b) by 615 days.

(21) Appl. No.: 12/353,923

(22) Filed: Jan. 14, 2009

(65) Prior Publication Data

US 2009/0181604 A1 Jul. 16, 2009

Related U.S. Application Data

(60) Provisional application No. 61/021,323, filed on Jan. 15, 2008.

(51) Int. Cl.
*B24B 23/00* (2006.01)

(52) U.S. Cl. ..... 451/359; 451/451; 451/454; 451/456

(58) Field of Classification Search ..... 451/344, 451/358, 359, 451, 454, 455, 456, 457, 294, 451/508; 30/284, 285, 286; 83/665, 666; 248/74.4

See application file for complete search history.

(56) References Cited

U.S. PATENT DOCUMENTS 907,734 A 12/1908 Butterfield
1,123,562 A 1/1915 Lund
RE15,262 E 1/1922 Gurgel
1,643,882 A 9/1927 Faiver
2,032,382 A 3/1936 Torrison
2,041,689 A 5/1936 Baumeister et al.
2,291,269 A * 7/1942 Wiggleworth ..... 451/398
2,478,074 A 8/1949 Atkin
2,503,854 A 4/1950 Trainor
2,520,725 A 8/1950 Judd
2,803,098 A 8/1957 Robert et al.
2,819,570 A 1/1958 Tocci-Guilbert et al.
2,819,571 A 1/1958 Morgan
2,994,995 A * 8/1961 Rolland ..... 451/294
3,166,877 A * 1/1965 Reames ..... 451/510
3,256,648 A * 6/1966 Subonovich ..... 451/456
3,468,076 A 9/1969 Jones
3,667,170 A * 6/1972 MacKay, Jr. ..... 451/521
3,673,744 A 7/1972 Oimoen
3,835,543 A * 9/1974 Polydoris et al. ..... 33/781
3,848,686 A 11/1974 Jysky et al.
3,862,521 A 1/1975 Isaksson
3,882,598 A 5/1975 Earle et al.
(Continued)

FOREIGN PATENT DOCUMENTS

EP 556713 A2 * 8/1993
(Continued)

*Primary Examiner* — George Nguyen
(74) *Attorney, Agent, or Firm* — Bateman IP

(57) ABSTRACT

A dust shroud for rotary tools includes a front half and a back half which are attachable together along an axis thereof to form a dust shroud. The dust shroud is mountable to a rotary power tool after mounting a mandrel in the power tool, and includes one or more openings to allow a person to lock the shaft of the tool while the dust shroud is mounted thereto to allow a person to change a worn out abrasive pad. The dust shroud is particularly suited for use with die grinders and similar rotary tools.

14 Claims, 5 Drawing Sheets

U.S. PATENT DOCUMENTS 3,882,644 A 5/1975 Cusumano
4,002,182 A 1/1977 Michel
4,063,478 A 12/1977 Stuy
4,090,297 A 5/1978 Wanner et al.
4,135,334 A 1/1979 Rudiger
4,253,362 A 3/1981 Olson
4,381,628 A 5/1983 Dicke
4,400,995 A * 8/1983 Palm ..... 74/527
4,574,532 A 3/1986 Haberle et al.
4,576,072 A 3/1986 Terpstra et al.
4,622,782 A 11/1986 Roestenberg
4,697,389 A 10/1987 Romine
4,761,877 A * 8/1988 Rupp ..... 483/54
4,782,632 A 11/1988 Matechuk
4,868,949 A 9/1989 Loveless et al.
4,932,163 A * 6/1990 Chilton et al. ..... 451/359
4,932,164 A 6/1990 Sullivan et al.
5,033,552 A * 7/1991 Hu ..... 173/217
5,074,044 A 12/1991 Duncan et al.
5,084,972 A 2/1992 Waugh
5,105,585 A 4/1992 Hampl et al.
5,125,190 A 6/1992 Buser et al.
5,163,252 A 11/1992 Garner et al.
5,167,215 A 12/1992 Harding, Jr.
5,201,785 A * 4/1993 Nagano ..... 451/508
5,237,781 A 8/1993 Demetrius
5,327,649 A 7/1994 Skinner
5,339,571 A * 8/1994 Timmons et al. ..... 451/342
5,411,433 A 5/1995 Keller
5,435,066 A 7/1995 Bare et al.
5,440,809 A 8/1995 Padilla
5,545,082 A 8/1996 Courson et al.
5,558,571 A * 9/1996 Toyoshima et al. ..... 451/358
5,564,408 A 10/1996 Bassols
5,566,457 A 10/1996 Batschari et al.
5,575,035 A 11/1996 Reis et al.
5,588,213 A 12/1996 Swanberg
5,609,516 A 3/1997 Courson et al.
5,653,561 A 8/1997 May
5,675,895 A 10/1997 Mori et al.
5,688,082 A 11/1997 Richardson
5,704,956 A 1/1998 Loveless et al.
5,713,785 A 2/1998 Nishio
D392,531 S 3/1998 Richardson
5,774,992 A 7/1998 Lindenmuth
5,791,979 A 8/1998 Duncan et al.
5,816,733 A 10/1998 Ishikawa et al.
5,931,072 A 8/1999 Shibata
5,954,863 A 9/1999 Loveless et al.
6,027,399 A 2/2000 Stewart
6,053,674 A 4/2000 Thompson
6,108,912 A 8/2000 Radigan
6,138,317 A * 10/2000 Holmes et al. ..... 15/180
6,167,626 B1 1/2001 Doumani et al.
6,219,922 B1 4/2001 Campbell et al.
6,318,352 B1 11/2001 Gnazzo et al.
6,347,985 B1 2/2002 Loveless
6,471,574 B1 10/2002 Rupprecht et al.
6,557,261 B1 5/2003 Buser et al.
6,648,742 B1 11/2003 Segiel Jr.
6,699,114 B1 3/2004 Booeshagi et al.
6,726,554 B1 4/2004 Chen et al.
6,748,660 B2 6/2004 Buser et al.
6,796,208 B1 9/2004 Jorgensen
6,811,476 B2 11/2004 Ohlendorf
6,855,040 B2 2/2005 Huber
6,860,799 B2 3/2005 Loveless
6,878,050 B2 4/2005 Wendt et al.
6,902,594 B2 6/2005 Cho
6,935,939 B1 8/2005 Buser et al.
7,047,647 B1 5/2006 Muller et al.
7,047,650 B2 5/2006 Chen
7,195,429 B2 3/2007 Dods et al.
7,197,826 B2 4/2007 Baxivanelis et al.
7,198,559 B2 * 4/2007 Walstrum et al. ..... 451/270
7,223,161 B2 5/2007 Kodani et al.
7,625,265 B2 12/2009 Woods et al.
7,635,293 B2 12/2009 Sun et al.
7,661,195 B1 2/2010 Wood et al.
7,740,086 B2 6/2010 Bleicher et al.
7,892,075 B2 2/2011 Esenwein
2005/0088866 A1 * 4/2005 Levine ..... 363/146
2006/0019585 A1 1/2006 Zayat
2007/0178815 A1 8/2007 Buser
2007/0193759 A1 * 8/2007 Sweig et al. ..... 173/198
2007/0251104 A1 11/2007 Heinrichs et al.
2008/0060631 A1 3/2008 Dofher
2008/0099053 A1 5/2008 Loveless
2008/0109986 A1 5/2008 Loveless
2008/0200103 A1 8/2008 Esenwein
2008/0271323 A1 * 11/2008 Perlmutter ..... 30/162
2009/0181604 A1 7/2009 Loveless
2009/0181605 A1 7/2009 Loveless
2009/0181606 A1 7/2009 Loveless
2009/0183377 A1 7/2009 Loveless
2009/0183800 A1 7/2009 Loveless
2009/0186559 A1 7/2009 Loveless
2009/0311953 A1 12/2009 Maute et al.

FOREIGN PATENT DOCUMENTS

EP 0579964 1/1994
GB 2 260 721 4/1993
GB 2262159 A 6/1993
JP 10-000559 1/1998
JP 10015717 A 1/1998
JP 2001096525 A 4/2001
KR 10-2002-0056086 7/2002
WO WO 9944786 A1 9/1999

* cited by examiner

DUST SHROUD FOR ROTARY TOOLS

RELATED APPLICATIONS

The present application claims the benefit of U.S. Provisional Application Ser. No. 61/021,323, filed Jan. 15, 2008, which is incorporated herein by reference in its entirety.

BACKGROUND OF THE INVENTION

1. The Field of the Invention

The present invention relates to dust shrouds. More specifically, the present invention relates to a dust shroud for rotary tools such as die grinders.

2. State of the Art

Dust shrouds have become more commonly used for many reasons. Die grinders, for example, are commonly used for grinding, paint removal, and other tasks. Without a dust shroud, debris is scattered over a wide area. It is desirable to contain the dust which is created for several reasons. It is desirable to contain the dust and debris to keep the workplace cleaner and to minimize the time necessary to clean up afterwards. Fine dust is often created which can be quite difficult to clean up afterwards. It is also desirable to contain the dust and debris to keep the same from getting into the tool itself, causing premature failure of the bearings, motor, etc. Additionally, debris such as paint dust poses a health risk to the machine operator and others who may breathe it. It is desirable to collect the dust to minimize any exposure.

Right angle die grinders are often used to remove paint from airplanes and other objects. In such a situation, it is not desirable that the paint debris is spread over the airplane as it may require extensive cleanup. Airplane paint often contains metals such as chromium and cadmium for corrosion protection. Workers may use a die grinder to remove paint from the airplane to service the airplane, repaint the airplane, etc. It is desirable to collect all of the paint which is removed to avoid environmental contamination or damage to the worker's health.

Paint removal with a die grinder typically involves the use of a mandrel with a backing pad that is mounted in the die grinder and an abrasive disk that is mounted to the backing pad. Commonly used abrasive disks require a half turn to lock the disk into the backing pad. One difficulty in providing dust shrouds for rotary tools is that the dust shroud will likely cover the collet and nut used to hold the mandrel and backing pad into the die grinder. Thus, the mandrel and backing pad are not easily installed after the shroud is in place. The shroud, however, ideally extends around the back of the backing pad and would be difficult to install if the mandrel and backing pad are mounted to the die grinder. Additionally, it is difficult to remove and attach the abrasive disks if a dust shroud is covering the collet, nut, and backing pad. Abrasive disks are typically replaced frequently during use as they wear.

The lack of an available dust shroud for rotary tools has resulted in workers being exposed to hazardous materials, or in companies having to create a large dust-sealed environment for performing work. Both of these situations are undesirable as they result in either increased cost or increased exposure to hazardous chemicals.

There is thus a need for a dust shroud for a die grinder or similar rotary tools. There is a need for a dust shroud which may be mounted easily to the tool after a mandrel has already been mounted to the tool, and which allows for easy replacement of abrasive disks.

SUMMARY OF THE INVENTION

It is an object of the present invention to provide an improved dust shroud for rotary tools such as die grinders.

According to one aspect of the invention, a dust shroud is provided which is split into two halves and which is assembled in place on the rotary tool. This allows the dust shroud to be placed on the tool after a mandrel or backing pad has been attached to the tool.

According to another aspect of the invention, the dust shroud allows some access to the collet or collet nut to allow a user to lock the shaft of the tool to facilitate attachment or removal of an abrasive disk from a mandrel.

These and other aspects of the present invention are realized in a universal dust shield as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
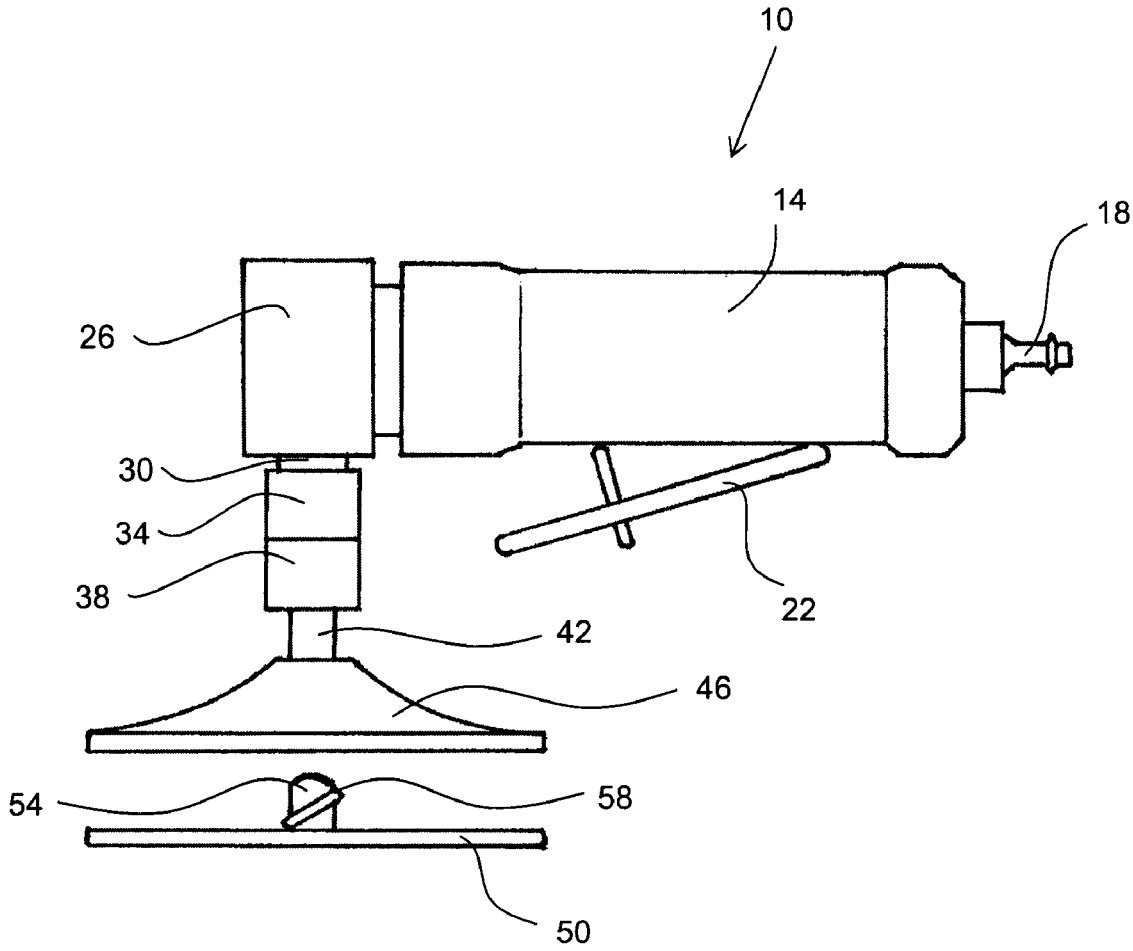
FIG. 1 (Prior Art)
FIG. 1 shows a side view of a prior art right angle die grinder.

Turning now to FIG. 1, a side view of a prior art right angle die grinder 10 is shown. The die grinder 10 typically includes a body 14 which houses an air turbine (not shown), an air inlet 18, a handle 22 for controlling the tool, a right angle gearbox 26, an output shaft 30, a collet 34, and a collet nut 38. The collet 34 and collet nut 38 are tightened with wrenches to mount a cutting or abrasive bit in the collet 34. The die grinder 10 rotates the cutting bit. A common use for die grinders 10 is to remove paint or otherwise clean or dress a surface. To perform this task, a mandrel 42 with a backing pad 46 is commonly used. The mandrel 42 is mounted into the collet 34 by tightening the collet nut 38.

An abrasive pad 50 is mounted to the backing pad 46 via a mounting post 54 with a coarse screw thread 58. The backing pad 46 has a corresponding receptacle. The abrasive pad 50 and backing pad 46 are designed to allow the abrasive pad to be easily mounted without tools. A user simply twists the abrasive pad 50 relative to the backing pad 46 with their hands. The user needs sufficient access to either hold the backing pad 46 or lock the shaft 30 to do so.

Figure 2:
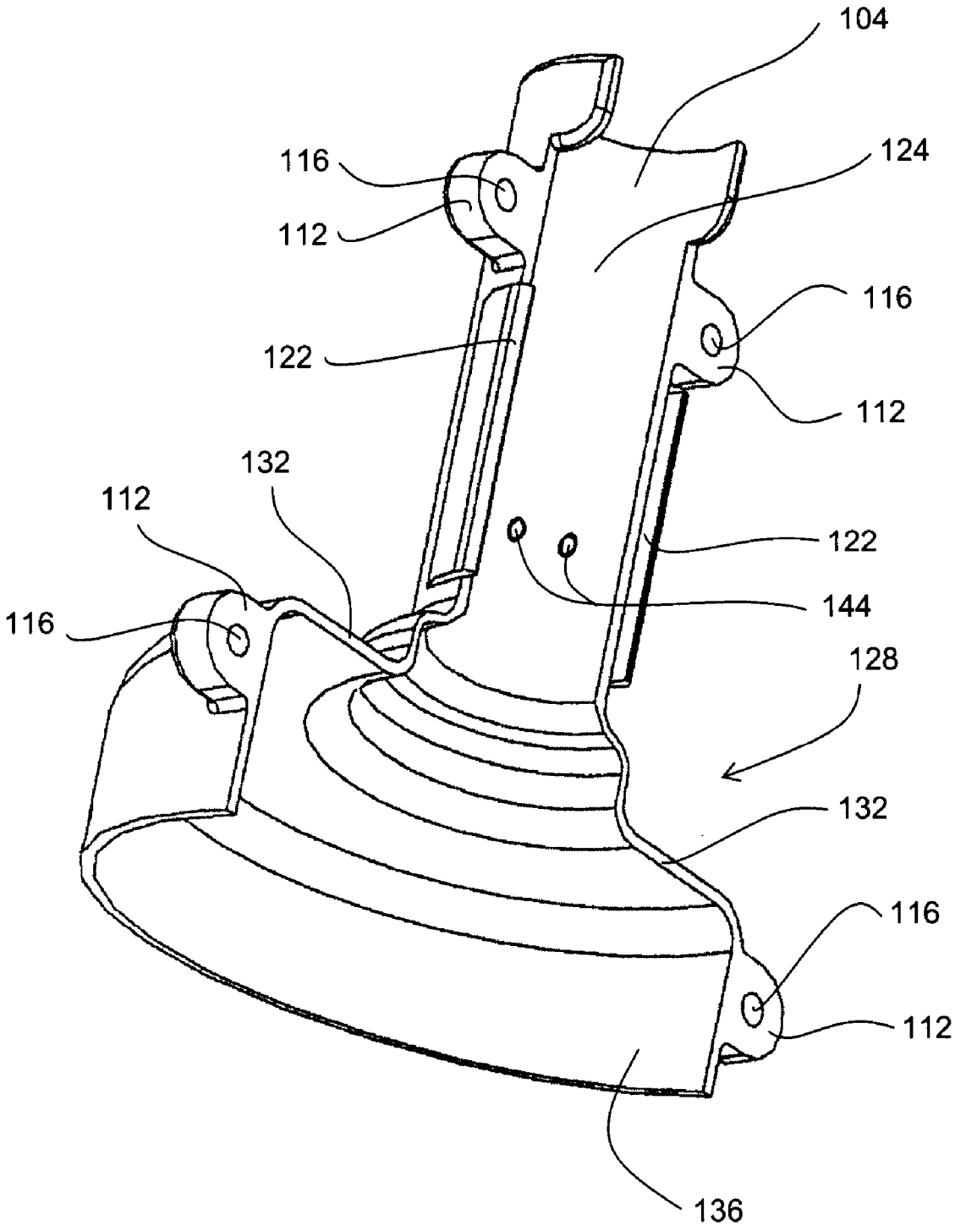
FIG. 2 shows a perspective view of the front half of a dust shroud of the present invention.
Figure 3:
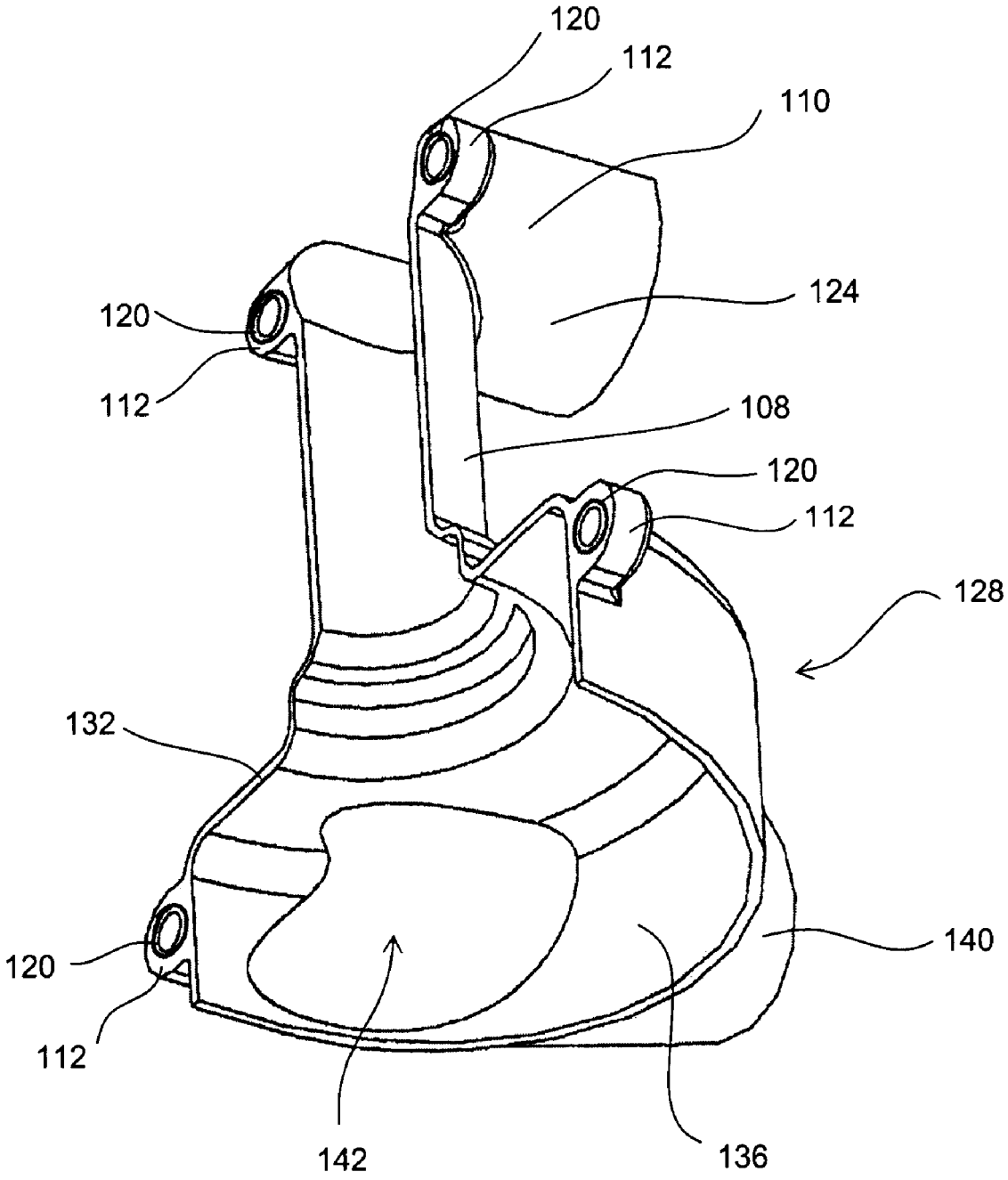
FIG. 3 shows a perspective view of the back half of the dust shroud of FIG. 2.
Figure 4:
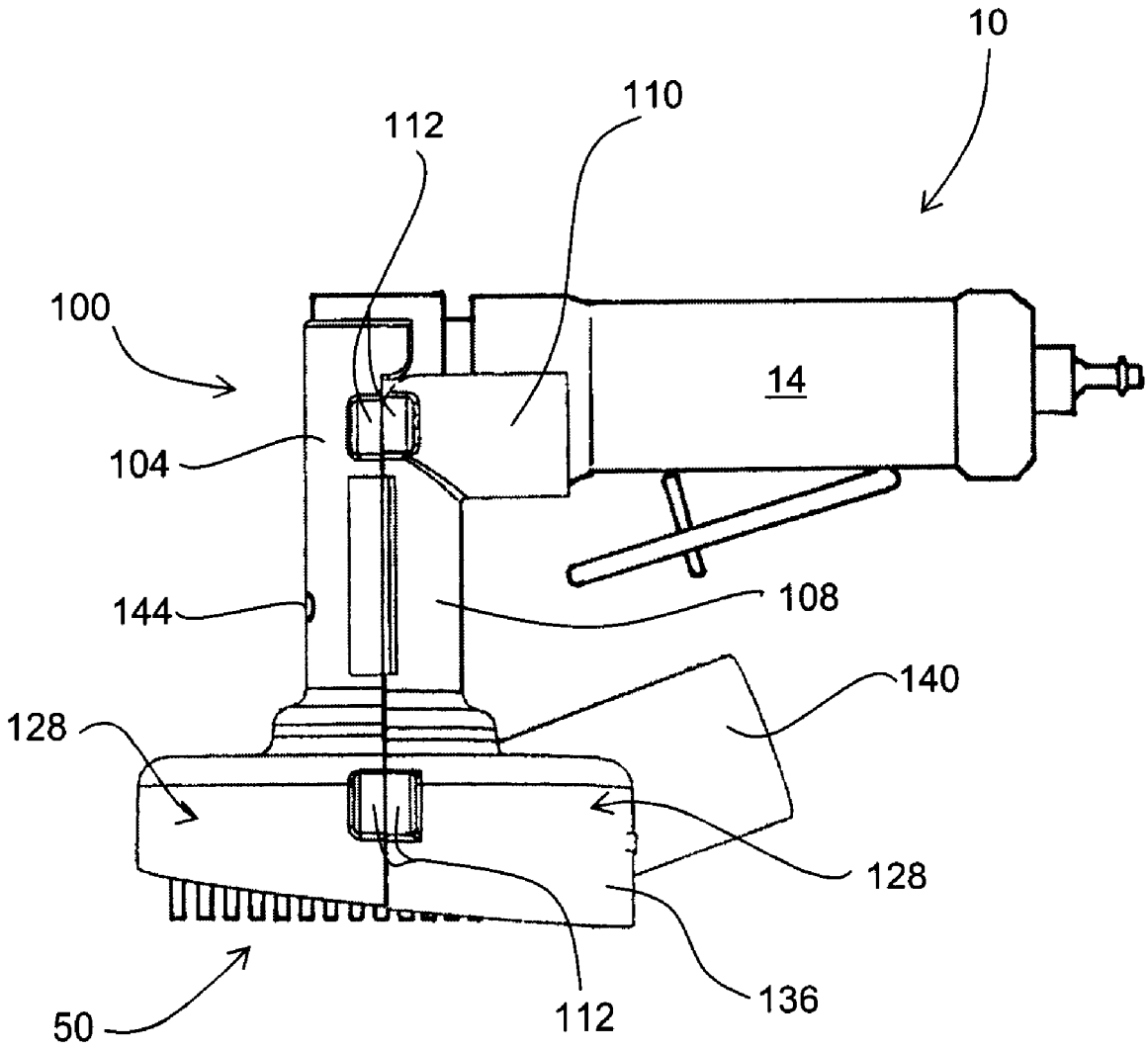
FIG. 4 shows a side view of the dust shroud of FIG. 1 mounted to a tool.
Figure 5:
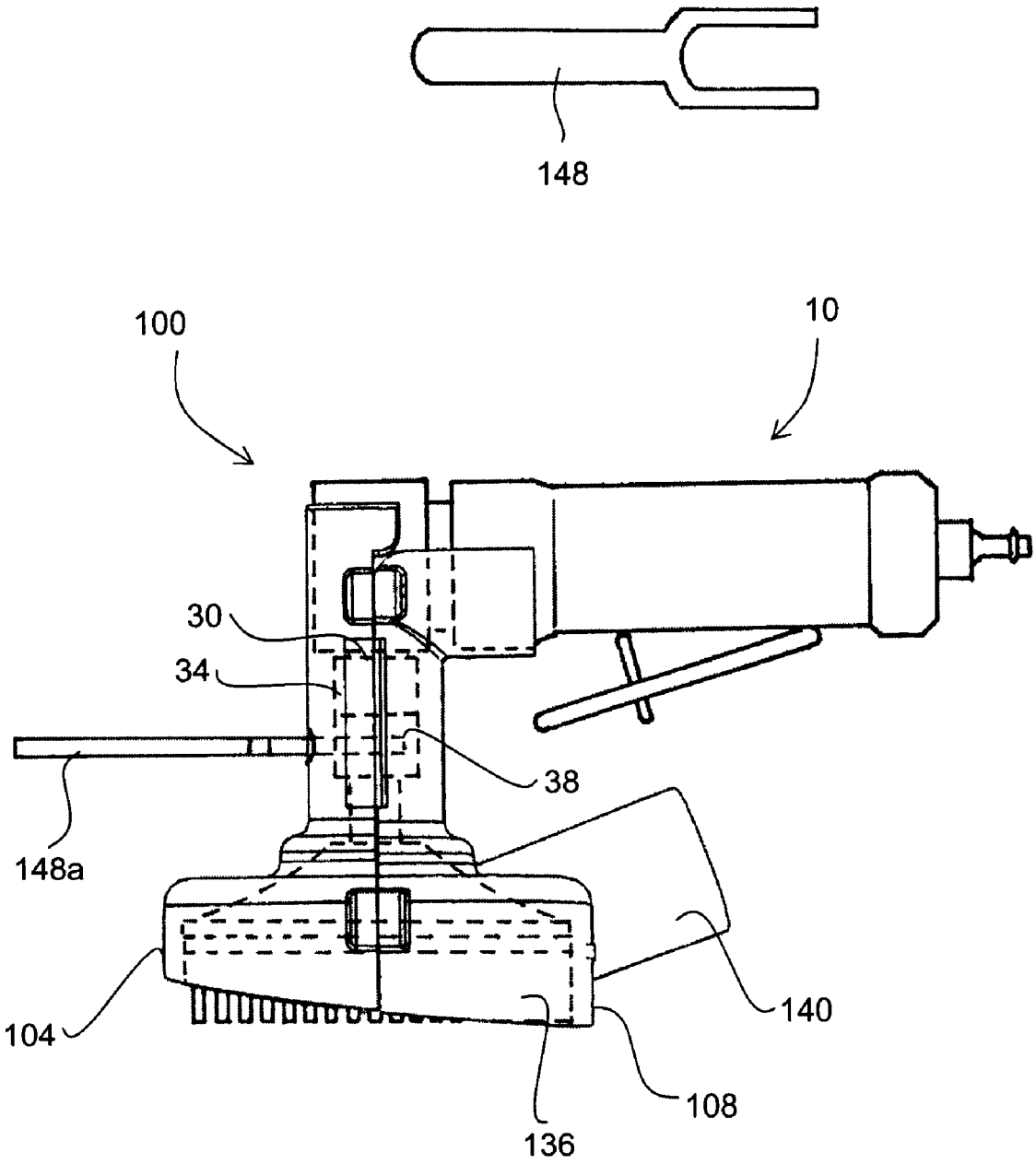
FIG. 5 shows another side view of the dust shroud of FIG. 1 mounted to a tool.

Turning now to FIGS. 2, 3, 4, and 5, a dust shroud for rotary tools according to the present invention is shown. FIGS. 2 and 3 show perspective views of the front and back of the shroud, and FIGS. 4 and 5 show the shroud mounted to a die grinder. As has been discussed, many uses of the die grinder 10 are for removing paint or otherwise preparing a surface. This type of work often generates debris which is hazardous. The dust shroud 100 is designed for use with an abrasive pad 50 and mandrel 42 as shown. The dust shroud 100 is shown for use with a right angle die grinder 10, but it will be appreciated that it may also be used with a straight die grinder by modifying the top of the shroud to exit straight instead of at a right angle.

The dust shroud 100 includes a front half 104 and a back half 108 which attach together. The shroud halves 104, 108 include tabs 112 which have holes 116 or threaded inserts 120 which receive bolts to connect the halves together. The front half 104 of the shroud includes flanges 122 which receive a portion of the back half 108 of the shroud to make the shroud 100 stronger and more secure during use. The upper body portion 124 of the shroud halves 104, 108 is shaped to fit snugly around the die grinder 10 to hold the shroud 100 in place. The shroud 100 includes an enlarged portion 128 which extends around the backing pad 46 and abrasive pad 50. The enlarged portion 128 includes a horizontally extending top 132 and a skirt 136.

As is seen, the back half 108 of the shroud 100 has an angled upper portion 110 which extends backwards at a right angle to the axis of the die grinder collet 34 and abrasive pad 50. The angled upper portion 110 extends along the handle portion of a right angle die grinder to help secure and stabilize the dust shroud 100. The dust shroud 100 is particularly used with a right angle die grinder since this die grinder is commonly used in applications which may generate hazardous dust, such as removing paint, and because such a dust shroud has been unavailable for such a die grinder.

As shown in FIG. 4, the skirt 136 may be tapered so as to be shorter at the front of the die grinder 10 and longer at the back of the die grinder. This allows a user to more easily use the abrasive pad 50 and die grinder 10, and promotes the proper positioning of the die grinder during use to allow the debris to be collected by a vacuum port 140. The vacuum port 140 is open to the enlarged portion 128 of the dust shroud 100 via opening 142 and connected to a vacuum so as to draw air from around the abrasive pad 50.

It will be appreciated in viewing the shroud 100 that it is difficult to mount a mandrel 42 with backing pad 46 in the collet 34 after a shroud is installed on the die grinder 10. This is because the die grinder obstructs access to the collet 34 and collet nut 38. The shroud 100 thus includes a front half 104 and back half 108 which may be assembled to the die grinder 10 after mounting the mandrel 42 in the collet 34. The shroud 100 provides a design which is easy to install on a die grinder or other similar tool after mounting a mandrel 42 in the collet 34 while still providing a shroud which is strong and not easily broken during use.

It is generally not problematic to require removal of the shroud 100 in order to remove the mandrel 42 and backing pad 46, as the mandrel is not frequently changed while a person is using the die grinder 10. As has been discussed, however, the abrasive pad 50 is changed frequently during use as the abrasive wears out. It is thus desirable to be able to change the abrasive pad 50 without removal of the shroud 100, thus promoting worker compliance in using the shroud. If a worker had to remove the shroud 100 in order to change the abrasive pad 50, many workers would simply leave the shroud off of the die grinder and not use the shroud.

The front half 104 of the shroud 100 is provided with holes 144 which allow a thin wrench to be inserted to engage the collet 34 or collet nut 38. The holes 144 could also be provided in the back half 108 of the shroud 100 if desired. FIG. 5 shows another side view of the shroud 100 and die grinder 10. The die grinder 10 and mandrel 42 are visible, but not all structures are numbered for clarity. A thin and elongate wrench 148 may be inserted through the holes 144 to engage the collet 34 or collet nut 38, as shown at 148*a*. The holes 144 allow the wrench 148 to be used to lock the shaft 30 and facilitate removal of the abrasive pad 50.

While the abrasive pad 50 is relatively easy to remove by hand, it can not be removed if the shaft 30 is freely spinning. The holes 144 and wrench 148 are beneficial as they provide a safe way to lock the shaft 30 and replace the abrasive pad 50. Without a convenient way to lock the shaft 30, a user may choose to not use the shroud 100, or may try to push a finger or other object between the backing pad 46 and shroud skirt 136 to lock the shaft 30. Both of these situations results in increased safety risks to the user.

There is thus disclosed an improved dust shroud for rotary tools. It will be appreciated that numerous changes may be made to the present invention without departing from the scope of the claims.

What is claimed is:

1. A dust shroud for rotary tools comprising:

a shroud which extends around a tool bit mounted in a rotary tool, the shroud having an upper portion and a circumferential skirt so as to cover the top of the tool bit and a portion of the sides of the tool bit;

an opening in the upper portion of the shroud adjacent the output shaft of the rotary tool;

a mount disposed about the opening, the mount being attachable to a body of the rotary tool;

a vacuum port disposed in fluid communication with the shroud so as to draw air from around the tool bit; and wherein the dust shroud has a joint which passes through said opening and which divides the shroud into a first part and a second part which is separate from the first part the first part being selectively attachable to the second part, and wherein the joint passes through the mount to divide the mount into a first portion and a second portion.

2. The dust shroud of claim 1, wherein the skirt is open across the entire bottom of the skirt and wherein the skirt is shorter on a first side and longer on a second side such that a bottom edge of the skirt angles upwardly relative to the upper portion of the shroud to expose more of the tool bit adjacent the first side of the skirt.

3. A dust shroud for rotary tools comprising:

a shroud which extends around a tool hit mounted in a rotary tool, the shroud having an upper portion and a circumferential skirt so as to cover the to of the tool bit and a portion of the sides of the tool bit;

an opening in the upper portion of the shroud adjacent the output shaft of the rotary tool;

a mount disposed about the opening, the mount being attachable to a body of the rotary tool;

a vacuum port disposed in fluid communication with the shroud so as to draw air from around the tool bit;

wherein the dust shroud has a joint which passes through said opening and which divides the shroud into a first part and a second part which is separate from the first part the first part being selectively attachable to the second part; and wherein the dust shroud comprises a hole formed in the mount configured for allowing a tool to be inserted therethrough to prevent rotation of an output shaft of the rotary tool so as to facilitate changing the tool bit.

4. A dust shroud rotary tools comprising:

at shroud which extends around a tool bit mounted in a rotary tool, the shroud having an upper portion and a circumferential skirt so as to cover the top of the tool bit and a portion of the sides of the tool bit;

an opening in the upper portion of the shroud adjacent the output shaft of the rotary tool;

a mount disposed about the opening, the mount being attachable to a body of the rotary tool;

a vacuum port disposed in fluid communication with the shroud so as to draw air from around the tool bit;

wherein the dust shroud has a joint which passes through said opening and which divides the shroud into a first part and a second part which is separate from the first part, the first part being selectively attachable to the second part; and wherein the mount comprises a first section extending upwardly from the upper portion of the shroud and a second section extending perpendicular to the first section.

5. A system comprising the dust shroud of claim 4, and further comprising a right angle die grinder having a handle and an output shaft extending perpendicularly from the handle, and when the dust shroud attaches to the angle grinder such that the first section of the mount covers the output shaft and such that the second section of the mount is attached to the handle of the angle grinder.

6. A dust shroud for rotary tools comprising:

a mount attachable to a rotary tool such that the mount engages a body of said tool and such that the mount is generally concentric with an output shaft of said tool;

a shroud having an upper surface and having a skirt extending downwardly from the upper surface such that the shroud defines a cavity which generally encloses an abrasive disk attached to the output shaft of the tool, the skirt being open across the bottom thereof and being shorter on a first side and longer on a second side such that a bottom edge of the skirt is not parallel to the upper surface of the shroud and such that the skirt exposes more of the abrasive disk on said first side; and a vacuum port, the vacuum port being disposed in communication with the shroud and attachable to a vacuum hose such that air around the abrasive disk is drawn from the shroud and into the vacuum; and wherein the mount encloses a collet of said tool, and wherein the mount has an opening thrilled therein for receiving a tool therethrough to engage the collet and thereby prevent rotation of the output shaft of the tool.

7. The dust shroud of claim 6 further comprising a tool configured for insertion through said opening and for engaging said collet.

8. The dust shroud of claim 6, wherein the shroud has a joint which passes through the mount portion and separates the shroud into a first pan and a second part.

9. The dust shroud of claim 8, wherein the first part and second part of the shroud separate about a line which passes through the output shaft of the tool.

10. The dust shroud of claim 6, wherein the mount comprises a first section thereof which extends parallel to the output shaft of the tool and generally encloses the output shaft of the tool and a second section which extends perpendicular to the first section of the mount and encloses a body portion of the tool, the body portion of the tool extending perpendicular to the output shaft of the tool.

11. A dust shroud comprising:

a shroud body having an upper surface and a skirt extending downwardly therefrom to generally enclose of tool bit, the skirt being open across the bottom of the skirt and being shorter on a first side and longer on a second side such that the skirt defines a lower edge which is not parallel to the upper surface of the shroud body;

an opening disposed in the upper surface, the opening being coincident with an output shaft of a tool when the dust shroud is attached to the tool; and a mount disposed around the opening, the mount being attachable to the tool to attach the shroud to the tool; and wherein the shroud body has a joint formed therein, the joint passing through the opening to separate the shroud body into a first part and a second part which are selectively attachable to each other, and wherein the joint separates the mount into a first mount part which is attached to the first shroud part and a second mount part which is attached to the second shroud part.

12. The dust shroud of claim 11, wherein the first part and the second part are of approximately equal size.

13. The dust shroud of claim 11, wherein the first part and the second part are separated about a plane passing through the output shaft of the tool.

14. A dust shroud comprising:

a shroud both having an upper surface and a skirt extending downwardly therefrom to generally enclose a tool bit, the skirt being open across the bottom of the skirt and being shorter on a first side and longer on a second side such that the skirt defines a lower edge which is not parallel to the upper surface of the shroud body;

an opening disposed in the upper surface, the opening being coincident with an output shaft of a tool when the dust shroud is attached to the tool;

a mount disposed around the opening, the mount being attachable to the tool to attach the shroud to the tool; and wherein the tool has a body and an output shaft which extends perpendicular to the body, and wherein the mount comprises a first section which extends perpendicular to the shroud body and generally encloses the output shaft and a second section which extends perpendicular to the first section and attaches to the tool body.

* * * * *